US009238873B2

(12) United States Patent
Lee et al.

(10) Patent No.: US 9,238,873 B2
(45) Date of Patent: Jan. 19, 2016

(54) ECO-FRIENDLY SMELTING PROCESS FOR REACTOR-GRADE ZIRCONIUM USING RAW ORE METAL REDUCTION AND ELECTROLYTIC REFINING INTEGRATED PROCESS

(75) Inventors: Jong Hyeon Lee, Daejeon (KR); Yoon Sang Lee, Daejeon (KR); Han Soo Lee, Daejeon (KR); Seon Jin Kim, Seoul (KR); Sun Kyo Chung, Daejeon (KR); H. Nersisyan Hayk, Daejeon (KR)

(73) Assignee: The Industry & Academic Cooperation in Chungnam National University, Daejeon (KR)

( * ) Notice: Subject to any disclaimer, the term of this patent is extended or adjusted under 35 U.S.C. 154(b) by 359 days.

(21) Appl. No.: 13/813,271

(22) PCT Filed: Jul. 29, 2011

(86) PCT No.: PCT/KR2011/005628

§ 371 (c)(1),
(2), (4) Date: Apr. 2, 2013

(87) PCT Pub. No.: WO2012/015278

PCT Pub. Date: Feb. 2, 2012

(65) Prior Publication Data

US 2014/0144786 A1 May 29, 2014

(30) Foreign Application Priority Data

Jul. 30, 2010 (KR) ..... 10-2010-0073841

(51) Int. Cl.
*C25C 3/26* (2006.01)
*C25C 3/00* (2006.01)
(Continued)

(52) U.S. Cl.
CPC ... *C25C 3/26* (2013.01); *C22B 5/04* (2013.01); *C22B 9/00* (2013.01); *C22B 34/14* (2013.01); *C22B 34/129* (2013.01)

(58) Field of Classification Search
CPC ..... C22B 13/06; C22B 5/00; C22B 34/1268; C22B 34/00; C25C 3/26; C25C 3/00; C25C 7/00; C25C 3/24; C01G 25/00; B01J 2523/48; B01J 27/135
USPC ..... 205/366, 397; 423/69, 492
See application file for complete search history.

(56) References Cited

U.S. PATENT DOCUMENTS 3,389,005 A * 6/1968 Kloepfer ..... C01G 25/02 106/450
3,701,649 A * 10/1972 Elis ..... 75/345
(Continued)

FOREIGN PATENT DOCUMENTS

JP 3501630 A 4/1991
JP 10204554 A 8/1998
(Continued)

OTHER PUBLICATIONS

Holloway et al., Use of Secondary Additives to Control the Dissolution of Iron during Na2CO3 Roasting of La Oroya Zinc Ferrite, Metallurgical and Materials Transactions B, Oct. 2007, 793-808, vol. 38B.
(Continued)

*Primary Examiner* — Zulmariam Mendez
(74) *Attorney, Agent, or Firm* — The Webb Law Firm

(57) ABSTRACT

The manufacturing method for high-purity Zirconium is characterized by self-propagating high temperature synthesis (SHS) of a raw material having zirconium raw ore containing $ZrO_2$, $ZrSiO_4$, $KZr_2(PO_4)_3$, or a mixture thereof and a reducing agent that is metal powder, to prepare zirconium intermetallic compound or zirconium nitride, followed by the recovery of high-purity Zr by electrolytic refining the reaction product of the SHS.

13 Claims, 10 Drawing Sheets

(51) Int. Cl.

| | |
|---|---|
| ***C25C 3/24*** | (2006.01) |
| ***B01J 27/135*** | (2006.01) |
| ***C22B 5/04*** | (2006.01) |
| ***C22B 9/00*** | (2006.01) |
| ***C22B 34/14*** | (2006.01) |
| *C22B 34/12* | (2006.01) |

(56) References Cited

U.S. PATENT DOCUMENTS

| | | | | |
|---|---|---|---|---|
| 4,231,994 | A | 11/1980 | MacDonald | |
| 4,897,116 | A | 1/1990 | Scheel | |
| 4,923,577 | A | 5/1990 | McLaughlin et al. | |
| 4,923,579 | A * | 5/1990 | Snyder et al. | 205/370 |
| 5,035,404 | A | 7/1991 | Abodishish | |
| 5,259,862 | A * | 11/1993 | White et al. | 75/363 |
| 8,277,558 | B2 | 10/2012 | Lee et al. | |
| 2009/0139444 | A1 * | 6/2009 | Lee et al. | 117/13 |
| 2011/0108434 | A1 | 5/2011 | Fujita et al. | |

FOREIGN PATENT DOCUMENTS

| | | | |
|---|---|---|---|
| JP | 201013668 | A | 1/2010 |
| KR | 19900004967 | A | 4/1990 |
| KR | 20000051648 | A | 8/2000 |
| KR | 1020060089253 | A | 8/2006 |
| KR | 100882578 | B1 | 2/2009 |

OTHER PUBLICATIONS

Kipouros and Flengas, Electrorefining of Zirconium Metal in Alkali Chloride and Alkali Fluoride Fused Electrolytes, Journal of the Electrochemical Society, 1985, 1087-1098, vol. 132, Issue 5.

Mallikarjunan and Sehra, Pyrometallurgical Processes for the Separation of Hafnium from Zirconium, Bull. Mater. Sci., Sep. 1989, 407-434, vol. 12, Nos. 3-4.

* cited by examiner

ECO-FRIENDLY SMELTING PROCESS FOR REACTOR-GRADE ZIRCONIUM USING RAW ORE METAL REDUCTION AND ELECTROLYTIC REFINING INTEGRATED PROCESS

TECHNICAL FIELD

The present invention relates to a method of obtaining zirconium having ultra high purity from a zirconium raw ore without using a chlorination process, and particularly, to a method of smelting reactor-grade zirconium for cladding a nuclear reactor from zirconium raw ore containing zirconium silicate ($ZrSiO_4$) or a mixture of zirconium raw ore and zirconium oxide using a metal reduction and electrolytic refining process.

BACKGROUND ART

Zirconium is used for cladding a fuel rod in a nuclear reactor or an alloy with uranium and importantly used as an internal material in the construction of the nuclear reactor, or the like, due to its own various properties such as high neutron transmittance, corrosion resistance, or the like. Zirconium has high strength at high temperature and is not easily corroded by circulating coolant. In addition, zirconium does not easily form a radioactive isotope and is less mechanically damaged by irradiation of neutrons. Since hafnium (Hf) chemically similar to zirconium and contained in all of zirconium ore has large thermal neutron absorption, in order to use zirconium in the nuclear reactor, a content of hafnium should be controlled to be 100 ppm or less during a smelting process.

To this end, a solvent extraction method is used. In this method, Hf is separated from Zr using tributyl phosphate (TBP) as an extracting agent in $ZrCl_4$ prepared by chlorination of the raw ore in an aqueous solution. The solvent extraction method may easily implement automation and have high separation efficiency to thereby be used in a wet refining process of commercial reactor-grade zirconium. However, as a raw material, chlorinated zirconium should be used, and a metal reduction process should be performed again through a conversion step since this process is a wet process, or the like, such that the process may be complicated.

After Hf is removed from Zr, a Kroll process is used at the time of preparing metal Zr. That is, precipitation and roasting are performed on Zr-salts subjected to solvent extraction to prepare $ZrO_2$, and chlorination is performed again, thereby obtaining pure $ZrCl_4$. This obtained $ZrCl_4$ is reacted with magnesium at about 800° C. using vapor to form a Zr metal, and then fused in inert gas to form a Zr base metal. High-purity Zirconium metal (purity of 99.8% or more) processed as a plate, wire, or the like, may be obtained by thermal decomposition (pyrolysis) of zirconium iodide, molten salt electrolysis of zirconium chloride, or the like.

A smelting process of zirconium according to the related art has been disclosed in a number of references documents. For example, a Kroll process for preparing zirconium metal has been disclosed in U.S. Pat. No. 5,035,404, a technology of removing Hf using an ion exchange resin has been disclosed in Japanese Patent Laid-Open Publication No. 1998-204554, and a process of removing Hf from Zirconium by a solvent extraction method has been disclosed in U.S. Pat. No. 4,231,994.

A purification process for preparing high-purity Zr using iodine has been disclosed in Japanese Patent Laid-Open Publication No. 1991-501630, and an electrolytic refining process using low purity Zr was reported in the Journal of Electrochemical Society, Vol. 132, No. 5, pp. 1087~1098 (1985).

Meanwhile, various pyrochemical processes for removing Hf from Zr using molten salts were arranged in Bulletin of Materials Science, Vol. 12, No. 3&4, pp. 407~434 (1989).

However, in the technology disclosed in the above-mentioned existing processes, since $ZrCl_4$ is prepared from zirconium raw ore by chlorination process and then a conversion process should be performed in multi-steps, chlorine gas having high toxicity is necessarily used, such that environmental pollution may be generated, and the process is complicated, such that there is a limitation in decreasing cost.

Therefore, the present applicant suggests a technology of performing direct metallization of zirconium from the raw ore without the chlorination process and recovering reactor-grade zirconium by an anode dissolution process.

DISCLOSURE

Technical Problem

An object of the present invention is to provide a smelting process for reactor-grade zirconium in which a concentration of Hf is significantly low by directly metallizing Zr raw ore using a metal reduction method without performing a chlorination process, preparing high conductive Zr metal compound having a form suitable for an electrolytic refining process, and selectively recovering only Zr from the Zr metal compound prepared as described above through an anode dissolution process using electrolytic refining process.

Technical Solution

A manufacturing method for high-purity Zirconium according to the present invention may include the following manufacturing method (I) or (II).

In one general aspect, a manufacturing method (I) for high-purity Zirconium is characterized by self-propagating high temperature synthesis (SHS) of a raw material having zirconium raw ore containing $ZrO_2$, $ZrSiO_4$, $KZr_2(PO_4)_3$, or a mixture thereof and a reducing agent, which is metal powder, to prepare $Zr_xSi_y$ (x is a real number of 1 to 5, and y is a real number of 1 to 4), followed by the recovery of high-purity Zr by electrolytic-refining $Zr_xSi_y$.

More particularly, in the manufacturing method (I) for high-purity Zirconium, the raw ore may be zirconium raw ore containing $ZrSiO_4$, and the raw material may further contain zirconium oxide, such that a liquid phase may be formed at the time of the SHS.

In another general aspect, a manufacturing method (II) for high-purity Zirconium is characterized by the SHS of a raw material having zirconium raw ore containing $ZrO_2$, $ZrSiO_4$, $KZr_2(PO_4)_3$, or a mixture thereof and a reducing agent that is metal powder, in a presence of nitrogen to prepare a mixture of HfN and ZrN, followed by the recovery of high-purity Zr by electrolytic-refining the mixture of HfN and ZrN.

In the manufacturing method (II) for high-purity Zirconium, at the time of the SHS, $Si_3N_4$, which is a synthesis product, may be volatilized and removed, such that high concentrated ZrN having excellent conductivity may be prepared by the SHS.

In the manufacturing method (I) or (II), high-purity Zirconium containing Hf impurity which is difficult to be separated by the electrolytic refining process at a concentration of 100 ppm (weight ppm) may be prepared, such that the prepared zirconium may be used as a cladding material for a cladding tube in a nuclear reactor without separate post-treatment.

In the manufacturing method (I) or (II), the reducing agent may be Al, Mg, or a mixture thereof, and in the case of the manufacturing method (II) in which the product of the SHS is ZrN, Al may be preferably used so that the liquid phase may be easily formed at the time of the SHS.

In the manufacturing method (I) or (II), at the time of the SHS, atmospheric gas may have pressure of 2 to 250 atm. A reaction product may be more densely prepared while smoothly propagating a combustion wave by controlling the atmospheric gas to 2 to 250 atm, and volatilization of the reducing agent injected as the raw material may be suppressed.

In the manufacturing method (I) or (II), a reaction product having a size of 5 to 10 mm in a granule or ingot form may be obtained by the SHS. The ingot may be prepared by melting $Zr_xSi_y$ prepared by the SHS before performing the electrolytic refining process, but the synthesis product itself of the SHS may be prepared in the ingot or granule form due to the liquid phase formed at the time of the SHS.

$Zr_xSi_y$ or ZrN used for the electrolytic refining process may be formed in a granule or ingot form instead of fine powder, such that the electrolytic refining process may be effectively and easily performed without requiring a separate pre-treatment, scattering of $Zr_xSi_y$ or ZrN in the molten salt, which is an electrolyte, may be prevented during the electrolytic refining process, and conductivity may increase to significantly increase electrolytic refining efficiency.

The manufacturing method (I) or (II), selectively, after the SHS, may further include removing metal oxide produced by oxidation of the reducing agent using acid leaching.

In the manufacturing method (I) or (II), the electrolytic refining process may be performed by electrodepositing pure Zr through an anode dissolution process of $Zr_xSi_y$ or ZrN produced by the SHS.

In detail, the electrolytic refining process may be performed using molten salts in which 3 to 10 weight % of zirconium halide is added to LiCl—KCl, LiF—KF, or LiF—KF—NaF eutectic salts, wherein the zirconium halide may be preferably zirconium chloride (including $ZrCl_4$ or $ZrCl_3$), zirconium fluoride (including $ZrF_4$ or $ZrF_3$), or a mixture thereof. The zirconium halide added to the eutectic salts may serve to oxidize base metal impurities based on redox potential of Zr and dissolve the metal impurities in the molten salts to allow electro-deposition of pure Zr to be performed.

In order to prevent Zr from being electro-deposited together with Hf and selectively high-purity Zr, cell potential at the time of electrolytic refining may be 0.5 to 2V. In addition, a mole ratio of hafnium ions to zirconium ions ($Hf^{4+}/Zr^{4+}$ or $Hf^{3+}/Zr^{3+}$) may be 0.5 or less. In this case, the mole ratio of the hafnium ion to the zirconium ion may be substantially 0 or more.

In the case of continuously electrolytic refining or electrolytic refining $Zr_xSi_y$ or ZrN on a large scale, the Hf ions may be concentrated in the molten salt. Therefore, it may be preferable that the mole ratio of the hafnium ion to the zirconium ion ($Hf^{4+}/Zr^{4+}$ or $Hf^{3+}/Zr^{3+}$) is maintained to be 0.5 or less by purifying the molten salt. More preferably, the sum of $Hf^{4+}/Zr^{4+}$ and $Hf^{3+}/Zr^{3+}$ is maintained to be 0.5 less.

In order to remove the Hf ion in the molten salt and reuse the molten salt, the molten salt may be purified by a Czochralski method. More specifically, the molten salts are sequentially and directionally solidified, and then Hf (Hf ions) dissolved in the molten salts may be removed using a fact that a content of thermally stable impurities is changed according to the temperature in a two phase region in which a solid phase and a liquid phase are co-exist in a phase diagram of substances configuring molten salts. A more detailed description of purification of the molten salt has been disclosed in Korean Patent Registration No. 0882578.

The Zr deposit prepared by the above-mentioned method may tend to be micronized while being re-dissolved by disproportionation reaction ($ZrF_4+Zr=2ZrF_2$, $\Delta G=-19.5$kJ/mol). In order to prevent this phenomenon, when $Zr^{4+}$ is stabilized by adding KF to the molten salt to form $K_2ZrF_6$, the disproportionation reaction is suppressed, thereby making it possible to obtain a coarse product. To this end, a composition of the molten salt may be preferably KF—LiF or KF—LiF—NaF binary or ternary eutectic salts.

Advantageous Effects

A manufacturing process according to the related art is a process in which a chlorination process of a raw ore, a multi-step conversion process are performed, such that the process may be complicated, easily generate pollution, and have a limitation in decreasing manufacturing cost. However, according to the present invention, since $Zr_xSi_y$ or ZrN may be rapidly prepared from the zirconium raw ore by direct metal reduction method without supplying additional heat and Hf, Si, N, other metal impurities may be removed by an electrolytic refining process, the chlorination process according to the related art may not be required, a multi-step solvent extraction process for removing Hf may also not be required, and manufacturing cost may be significantly decreased. In addition, in the manufacturing method for high-purity Zirconium according to the present invention, since use of gas having high toxicity may be excluded and an amount of generated waste may be significantly decreased, as compared with a existing Kroll method in which the chlorination process is performed and the solvent extraction method for removing Hf, this method may be usefully used to smelt reactor-grade zirconium.

DETAILED DESCRIPTION OF MAIN ELEMENTS

Figure 1:
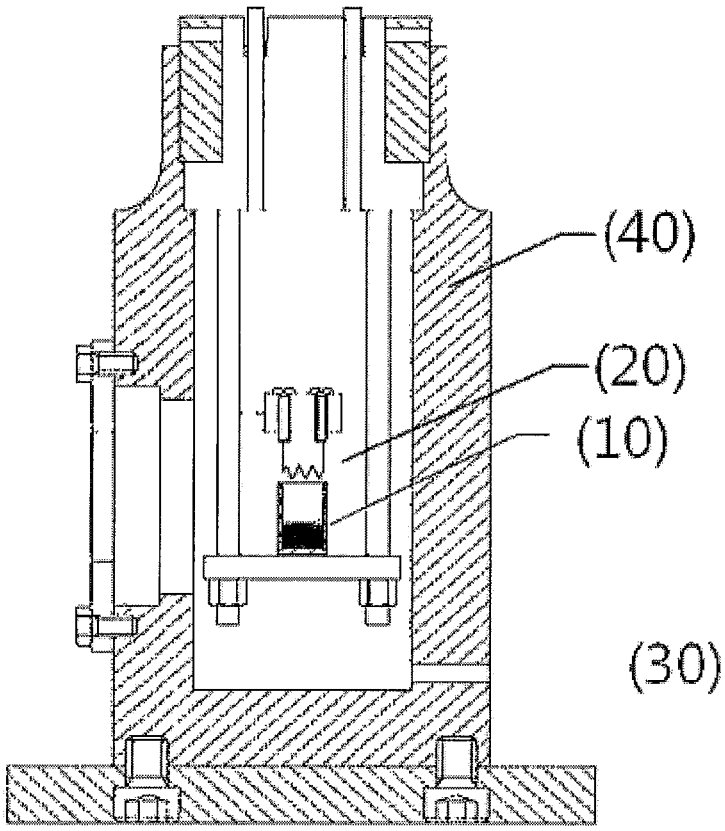
FIG. 1 is a mimetic view of a reaction apparatus for reducing Zr raw ore in order to perform a manufacturing method according to the present invention.

10: crucible for charging raw material, 20: filament for ignition

30: valve for vacuum and gas injection, 40: pressure reaction vessel for metal reduction

50: electrolytic refining reactor including heating apparatus, 60: Zr deposit recovery tank

70: screw conveyor for discharging Zr deposit

80: screw conveyor for discharging Si and impurities

90: anode basket, 100: cathode

110: anode current supply terminal, 120: cathode current supply terminal

130: motor for stirring and driving scraper, 140: anode rotating motor

150: vibration motor for separating deposit

160: scraper for stirring and deposit

BEST MODE

Hereinafter, a manufacturing method according to present invention will be described in detail with reference to the accompanying drawings. The drawings to be described below are provided by way of example so that the idea of the present invention can be sufficiently transferred to those skilled in the art to which the present invention pertains. Therefore, the present invention is not limited to the drawings to be provided below, but may be modified in many different forms. In addition, the drawings to be provided below may be exaggerated in order to clarify the scope of the present invention. Like reference numerals denote like elements throughout the specification.

Here, technical terms and scientific terms used in the present specification have the general meaning understood by those skilled in the art to which the present invention pertains unless otherwise defined, and a description for the known function and configuration obscuring the present invention will be omitted in the following description and the accompanying drawings.

In order to achieve the object as described above, the present invention suggests a method of preparing metallized zirconium and zirconium intermetallic compound from a raw ore without using chlorine gas and controlling a particle size of zirconium compounds so as to facilitate conduction at the time of electrolytic refining.

In a first aspect according to the present invention, a manufacturing method (I) for high-purity Zirconium is characterized by self-propagating high temperature synthesis (SHS) of a raw material containing zirconium raw ore containing $ZrO_2$, $ZrSiO_4$, $KZr_2(PO_4)_3$, or a mixture thereof and a reducing agent that is metal powder, to prepare $Zr_xSi_y$ (x is a real number of 1 to 5, and y is a real number of 1 to 4), followed by the recovery of high-purity Zr by electrolytic-refining $Zr_xSi_y$.

Particularly, the zirconium raw ore may be zirconium raw ore containing $ZrSiO_4$.

When the zirconium raw ore containing $ZrSiO_4$ and the material containing reducing agent, which is the metal powder, are reacted with each other, $Zr_xSi_y$ (x is a real number of 1 to 5, and y is a real number of 1 to 4) is generated, and each metal powder is oxidized to metal oxide.

In order to reduce zirconium raw ore using the SHS, which is a process in which reaction of the zirconium raw ore and the reducing agent spontaneously propagates due to propagation of a heat wave generated at the time of the reaction of the zirconium raw ore and the reducing agent, it is preferable that the reducing agent is Mg, Al or a mixed powder thereof. In this case, an amount of the reducing agent mixed with the raw ore may be 1 to 1.5 times larger than a chemically appropriate amount of the reducing agent required to reduce $ZrSiO_4$ contained in the zirconium raw ore.

In detail, as shown in following Reaction Formulas 1 and 2, Mg or Al is oxidized to MgO or $Al_2O_3$ by the SHS, and Gibbs free energy of the reactions are −522.9 kJ/mol(Mg) and −354.7 kJ/mol(Al), respectively. Therefore, it may be appreciated that the SHS may easily proceed.

Particularly, in the case in which Mg, Al or a mixed powder thereof is used as the reducing agent, an adiabatic temperature ($T_{ad}$) according to each of the reducing agents is 2066° C. (Mg) or 1696° C. (Al). Therefore, it may be appreciated that an aluminothermic or magnesiothermic reaction may spontaneously propagate and proceed without supplying additional heat.

$$ZrSiO_4+4Mg=ZrSi+{}_4MgO,\ \Delta G_{300K}=-522.9\ \text{kJ/mol},\ T_{ad}=2066^\circ\ \text{C.} \quad (1)$$

$$ZrSiO_4+2.667Al=ZrSi+1.333Al_2O_3,\ \Delta G_{300K}=-354.7\ \text{kJ/mol},\ T_{ad}=1696^\circ\ \text{C.} \quad (2)$$

In this case, describing melting points of each of the products, ZrSi has a melting point of 2095° C., MgO has a melting point of 2832° C., and $Al_2O_3$ has a melting point of 2054° C. Therefore, it may be appreciated that the produced ZrSi has the higher melting point than the adiabatic temperature, such that an SHS product may be obtained in a powder form.

In order to introduce ZrSi into the electrolytic refining process, it is preferable that a reaction product having a size of 5 to 10 mm in a granule or ingot form rather than fine powder form in consideration of conductivity at an anode and a scattering problem in an electrolyte.

To this end, it is preferable that zirconium oxide ($ZrO_2$) for forming a liquid phase is added to the above-mentioned raw material. In this case, the raw material may preferably contain 0.9 to 1.1 mol of zirconium oxide based on mol of $ZrSiO_4$ contained in the raw material.

In the case in which the raw material contains zirconium oxide together with the zirconium raw ore containing $ZrSiO_4$ and the reducing agent, which is the metal powder, a reaction represented by the following Reaction Formula 3 is generated, such that the liquid phase is formed at 1570° C. or more, that is, the melting point, thereby obtaining a coarser product. In this case, an amount of the reducing agent mixed with the raw ore may be 1 to 1.5 times larger than a chemically appropriate amount of reducing agent required to reduce $ZrSiO_4$ contained in the zirconium raw ore and zirconium oxide.

$$ZrSiO_4+ZrO_2+6Mg=Zr_2Si+6MgO,\ \Delta G_{300K}=-673.6\ \text{kJ/mol},\ T_{ad}=1803^\circ\ \text{C.} \quad (3)$$

An atmosphere inside a reactor in which the SHS is performed according to the first aspect may be inert gas atmosphere. Further, pressure of atmospheric gas (inert gas) is 2 to 250 atm at the time of the SHS. The pressure of the atmospheric gas is controlled to 2 to 250 atm, such that a loss due to volatilization of the reducing agent, which is the metal powder, may be suppressed, and a denser product may be prepared. The dense product may prevent scattering of the product in the molten salt at the time of electrolytic refining and increase conductivity, such that the dense product may be advantageous in view of current efficiency.

In a second aspect according to the present invention, a manufacturing method is characterized by the SHS of a raw material containing zirconium raw ore containing $ZrO_2$, $ZrSiO_4$, $KZr_2(PO_4)_3$, or a mixture thereof and a reducing agent that is metal powder, in a presence of nitrogen to prepare ZrN, followed by the recovery of high-purity Zr by electrolytic-refining ZrN. In this case, as described above, the zirconium raw ore contains Hf as impurities. Therefore, in the case in which the SHS is performed in the presence of nitrogen, HfN is also obtained together with ZrN. In this method, a mixture of HfN and ZrN that are obtained by the SHS is electrolytic refined, such that high-purity Zr may be recovered.

Particularly, the raw ore may be zirconium raw ore containing $ZrSiO_4$.

In the second aspect of the present invention, nitrogen is introduced in order to obtain the SHS product having a size of 5-10 mm in the granule or ingot form rather than the fine powder form. Particularly, ZrN generated by the SHS is a zirconium compound appropriate for the electrolytic refining process since ZrN has excellent conductivity to increase an electrical contact between packing materials at the anode at the time of the electrolytic refining.

Nitrogen may be nitrogen gas, and the atmospheric gas in the reactor in which the SHS is performed may be controlled by nitrogen gas. In this case, similarly to the above mentioned first aspect, pressure of nitrogen gas at the time of SHS may be 2 to 250 atm, such that a loss due to volatilization of the reducing agent, which is the metal powder, may be suppressed, and a denser product may be prepared.

When nitrogen gas is introduced in a reduction reaction of the zirconium raw ore containing $ZrSiO_4$, the adiabatic temperature is a high temperature of 2000° C. or more due to high heat of formation of zirconium nitride and silicon nitride. For example, in the case in which the reducing agent contains Mg, the adiabatic temperature becomes 2825° C. as shown in the following Reaction Formula 4. In this case, since a sublimation temperature of $Si_3N_4$ is 1878° C., silicon nitride generated by SHS may be a gas phase to thereby be removed.

$$3ZrSiO_4+12Mg+3.5N_2(g)=3ZrN+Si_3N_4+12MgO,\quad \Delta G_{300K}=-2835\text{ kJ/mol},\ T_{ad}=2825^\circ\text{ C.} \tag{4}$$

Meanwhile, in the case in which the reducing agent contains Al, since AlN is prominently formed rather than $Si_3N_4$, a reaction shown in the following Reaction Formula 5.

$$1.5ZrSiO_4+3.5Al+1.5N_2(g)=1.5ZrN+Al_2O_3+1.5SiO_2+1.5AlN,\ \Delta G_{300K}=-937.9\text{ kJ/mol},\ T_{ad}=2292^\circ\text{ C.} \tag{5}$$

In the case in which the reducing agent contains Al, the adiabatic temperature is 2292° C., which is slightly lower than that in the case of Mg but higher than the melting point of $Al_2O_3$, such that the liquid phase is formed at the time of the SHS, thereby making it possible to obtain the reaction product having a size of 5 to 10 mm in a granule or ingot form.

In the case in which pure Zr is prepared the above-mentioned SHS (in the first or second aspect), a possibility of ignition of Zr powder may be decreased, and manufacturing cost may also be decreased. Further, as a method of increasing combustion temperature, spark for the SHS may be performed while pre-heating the raw material at a temperature of 25 to 600° C.

$Zr_xSi_y$ (x is a real number of 1 to 5, and y is a real number of 1 to 4) or ZrN, which are reaction products obtained by the above-mentioned SHS contain a trace amount of impurities and oxides of the metal used as the reducing agent, such that it is impossible to apply the reaction products to reactor-grade zirconium.

Therefore, a process of electrolytic refining $Zr_xSi_y$ or ZrN using excellent conductivity of $Zr_xSi_y$ or ZrN, which are reaction products obtained by the above-mentioned SHS, and selectively dissolving only Zr through an anode dissolution process to recover high-purity Zr is performed.

In more detail, an anode dissolution process of ZrN including HfN is as follows.

$$ZrN=Zr^{3+}+\tfrac{1}{2}N_2+3e \tag{6}$$

$$HfN=Hf^{3+}+\tfrac{1}{2}N_2+3e \tag{7}$$

Therefore, during the electrolytic refining process, nitrogen gas is generated at the anode, and $Al_2O_3$, $SiO_2$, $Si_3N_4$, or the like, remain at the anode as a solid powder state since they do not have conductivity. At this time, a step of mixing the reaction product of the SHS with acid to leach and remove oxides (for example, MgO) of the metal (for example, Mg) used as the reducing agent may be selectively performed before the electrolytic refining process. However, the leaching using acid may not be performed. In this case, the oxides, nitrides, silicon oxides, or the like, of the metal used as the reducing agent, which is insoluble in an electrolytic refining condition, may be recovered in a slurry form at the anode.

A salt used as the electrolyte in the electrolytic refining process is a salt to which 3 to 10 weight % of zirconium halide is added, and any salt may be used as long as the salt may be electrochemically stable in a redox potential range of zirconium. However, it is preferable in view of effective purification of the salt that the salt is LiCl—KCl eutectic salt (58.8 mol % LiCl— 41.2 mol % KCl).

At the time of the electrolytic refining, in the case of respective impurities, based on the redox potential of Zr, a noble metal is not ionized at the anode, and a base metal is oxidized by the added Zr salt to thereby be dissolved in the molten salt, such that pure Zr may be electrodeposited.

However, in the case of Hf, since a difference in the redox potential between Hf and Zr is significantly small, Hf may be electrodeposited together with Zr. Since the reported redox potential of Hf(IV)/Hf(0) is −1.108V (Ag/AgCl), the redox potential of Zr(IV)/Zr(0) is −1.088V (Ag/AgCl), the difference is only 0.02V (U.S. Pat. No. 4,923,577, 1990).

It may be practically difficult to separate Hf while mechanically maintaining this potential difference. However, reactions represented by the following Reaction Formulas 8 and 9 may be thermodynamically carried out, such that a limitation of the potential difference may be overcome.

$$ZrCl_4+Hf=Zr+HfCl_4,\ \Delta G_{773K}=-15.3\text{ kJ/mol} \tag{8}$$

$$ZrF_4+Hf=Zr+HfF_4,\ \Delta G_{773K}=-22.2\text{ kJ/mol} \tag{9}$$

Reaction Formulas shown above means that metal Hf may be oxidized by the Zr salt in the molten salt to thereby be dissolved in the molten salt as $HfCl_4$ or $HfF_4$, and it may be appreciated that ΔG at 773K is −15.3 kJ/mol and −22.2 kJ/mol, the Hf may be thermodynamically separated. In this case, an equilibrium constant K has relationships represented by the following Equations 10 and 11 with a concentration α of each substance related with the reactions, a reaction temperature T, and Gibbs free energy ΔG at the temperature T.

$$K = \frac{a_{Zr}a_{HfCl_4}}{a_{ZrCl_4}a_{Hf}} = e^{-\frac{xG}{RT}} = 10.91 \quad (10)$$

$$K = \frac{a_{Zr}a_{HfF_4}}{a_{ZrF_4}a_{Hf}} = e^{-\frac{xG}{RT}} = 31.67 \quad (11)$$

In addition, reactions of $Zr^{3+}$ and $Hf^{3+}$ are as follows.

$$ZrCl_3 + Hf = Zr + HfCl_3,\ \Delta G_{773K} = -62.2\ \text{kJ/mol} \quad (12)$$

$$ZrF_3 + Hf = Zr + HfF_3,\ \Delta G_{773K} = -81.9\ \text{kJ/mol} \quad (13)$$

$$K = \frac{a_{Zr}a_{HfCl_3}}{a_{ZrCl_3}a_{Hf}} = e^{-\frac{xG}{RT}} = 1.6\times10^4 \quad (14)$$

$$K = \frac{a_{Zr}a_{HfF_3}}{a_{ZrF_3}a_{Hf}} = e^{-\frac{xG}{RT}} = 3.4\times10^5 \quad (15)$$

Therefore, in the case in which the electrolyte contains zirconium halide, particularly zirconium chloride or fluoride, Hf may be removed. In addition, when a concentration of $ZrCl_4(ZrCl_3)$ or $ZrF_4(ZrF_3)$ is significantly high or a concentration of $HfCl_4(HfCl_3)$ or $HfF_4(HfF_3)$ is significantly low, the equilibrium constant is increased, such that the dissolution reaction of Hf may be promoted.

On the contrary, since purity of cathode Zr deposit may be decreased when the concentration of $Hf^{4+}(Hf^{3+})$ is increased, it may be preferable that a mole ratio of $Hf^{4+}/Zr^{4+}(Hf^{3+}/Zr^{3+})$ in the molten salt, which is the electrolyte used at the time of electrolytic refining, is maintained to 0.5 or less through an immediate purification process.

The purification process of the molten salt in order to remove Hf from the molten salt uses a solubility difference in liquid phase and solid phase between the electrolyte and impurity salts. More specifically, Zr and Hf salts are concentrated using the fact that the solubility of the Zr and Hf salts in the electrolyte is lowered at the time of solidification, the Hf salt is removed through a fractional distillation process and the recovered Zr salt is reused in the electrolytic refining process. In more detail, the principle disclosed in Korean Patent No. 10-0882578 entitled "Czochralski apparatus for growing crystals and purification method of waste salts using the same" is equally used, and a crystal growth rate may be changed according to component compositions of waste salts.

As the electrolytic refining condition, when the electrolytic refining is performed at cell potential of 0.5 to 2V, pure zirconium may be easily recovered. In the case in which an anode basket is made of stainless steel, an anode potential may be controlled at −0.5V or less in order to prevent iron from being dissolved.

As described above, the manufacturing method for high-purity Zirconium according to the present invention may directly reduce zirconium from low grade raw ore to prepare intermetallic compound or zirconium nitride and anode-dissolving the prepared intermetallic compound or zirconium nitride, thereby making it possible to remove use of chlorine gas and a factor of increasing manufacturing cost, as compared with a method suggested by McLaughlin et al., (U.S. Pat. No. 4,923,577, May 8, 1990). In addition, as compared with a method suggested by A. M. Abdelkader et al., (Metallurgical and Materials Transactions B, 2007; 38B:35-44), the manufacturing method for high-purity Zirconium according to the present invention may increase economic efficiency by directly contacting the low grade raw ore with metal reducing powder without using $ZrO_2$ as the raw material to complete the reaction in a short time.

FIG. 1 is a mimetic view showing an example of an apparatus in which the SHS may be performed in a manufacturing method according to the present invention. Referring to FIG. 1, the apparatus may be configured to include a crucible 10 for charging raw materials at a controlled temperature; a filament 20 installed on an upper end portion of the crucible and igniting the mixture of raw materials so that the reduction reaction starts; a valve 30 for injecting inert atmospheric gas or nitrogen gas; and a pressure reaction vessel 40 for performing reaction at high pressure.

Figure 2:
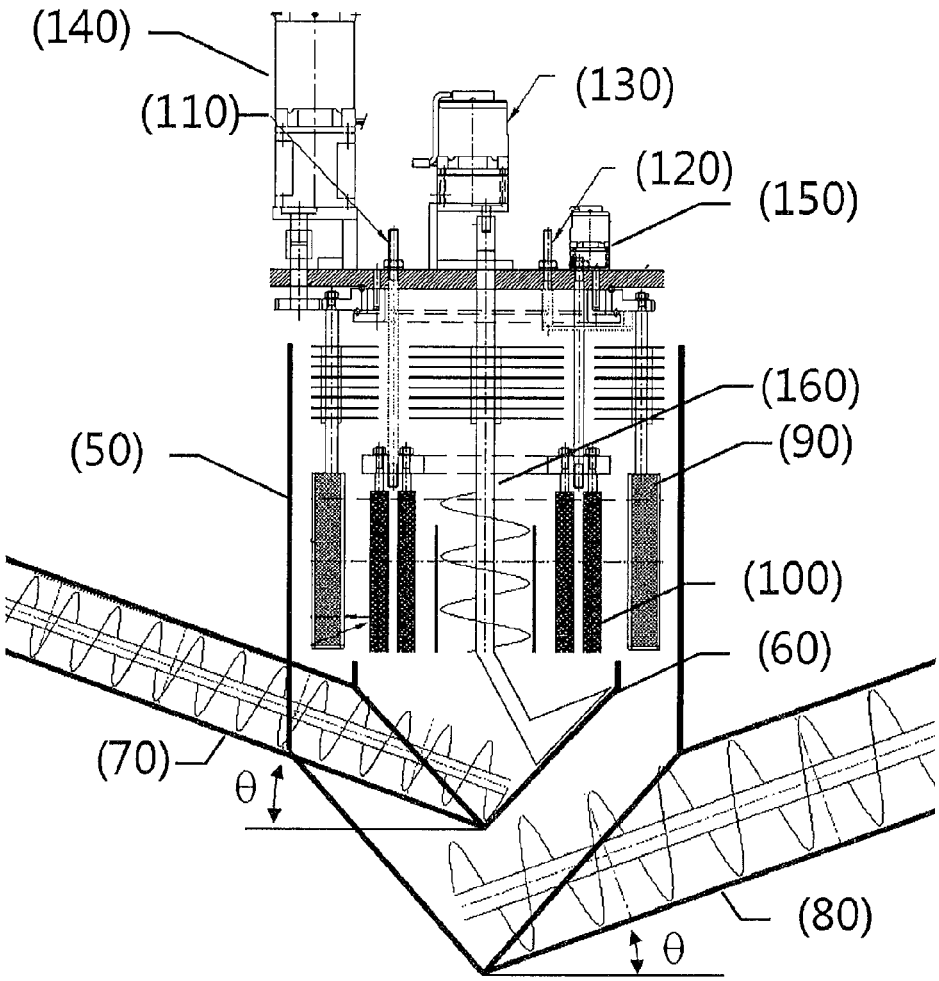
FIG. 2 is a mimetic view of molten salt electrolytic refining apparatus in order to perform the manufacturing method according to the present invention.

FIG. 2 is a mimetic view showing an example of an apparatus in which the electrolytic refining for recovering pure Zr may be performed. Referring to FIG. 2, the apparatus may be configured to include an electrolytic refining apparatus including a reactor 50 including a heating part for dissolving the raw material salts at a controlled temperature; a deposit recovery tank 60 installed at a lower end portion of the crucible and recovering zirconium deposit separated from the cathode; a screw conveyor 70 for discharging the zirconium deposit from the deposit recovery tank to the outside of the molten salt; and a screw conveyor 80 installed at the lower end portion of the crucible and discharging silicon and transition metal impurities separated from the anode; the anode 90 for charging the reaction product by the SHS and an cathode 100 for pure Zr deposit; an anode current supply terminal 110; a cathode current supply terminal 120; a stirring motor 130; an anode rotating motor 140 and a vibration motor for separation cathode Zr deposit; and a Zr deposit scraper 160. In this case, the crew conveyors 70 and 80 may have an inclined angle of 20 degrees or less.

The following Examples are performed using apparatuses similar to those in FIGS. 1 and 2.

EXAMPLE 1

Preparation ZrSi by $ZrSiO_4$+Mg Reaction

Figure 3:
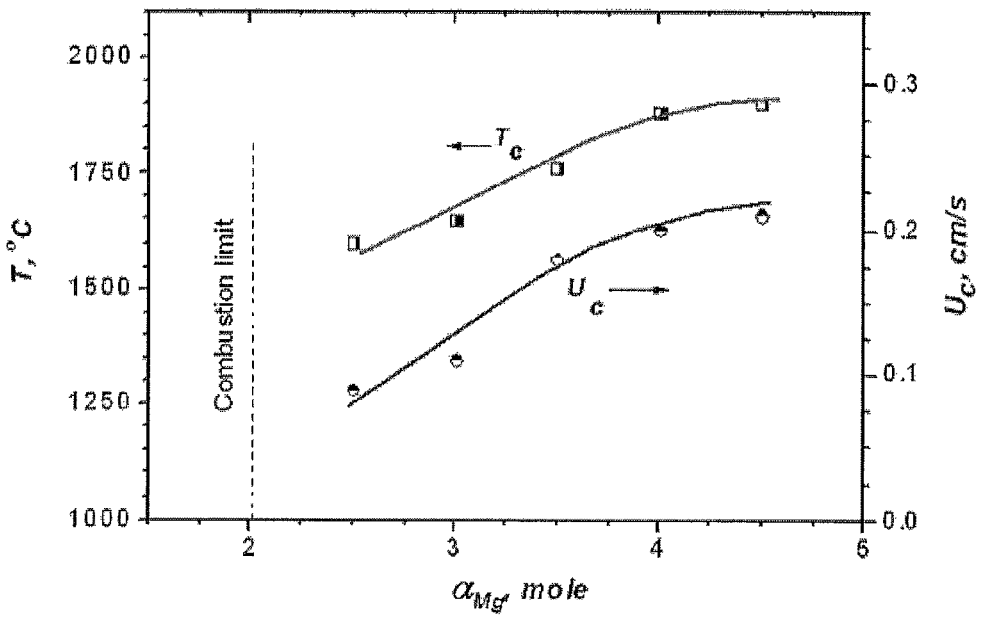
FIG. 3 is a graph showing results obtained by measuring a reaction temperature and a propagation rate of a combustion wave according to the mole ratio of Mg (Ar gas pressure: 25 atm, $ZrSiO_4+\alpha Mg$, $\alpha$=2.5, 3.0, 3.5, 4.0) in the manufacturing method according to the present invention).

In order to prepare ZrSi, properties of reaction products of $ZrSiO_4$ and αMg according to the α value were evaluated. FIG. 3 shows data obtained by measuring reaction temperatures and combustion wave propagation rates according to the mole ratio of Mg after pressure of Ar gas is maintained at 25 atm. When Mg is 2.5 mol, which was smaller than a stoichiometric ratio, the reaction temperature was 1600° C. and the combustion wave propagation rate was 0.09 cm/sec. The reaction temperature and the combustion wave propagation rate were linearly increased until the mole ratio of Mg arrives at 4 mol, which is the stoichiometric ratio, but the reaction temperature and the combustion wave propagation rate were not largely increased at 4.5 mol. The maximum reaction temperature was 1900° C. at 4.5 mol of Mg, the combustion wave propagation rate was 0.21 cm/sec, and rapid reaction rate was shown.

Figure 4:
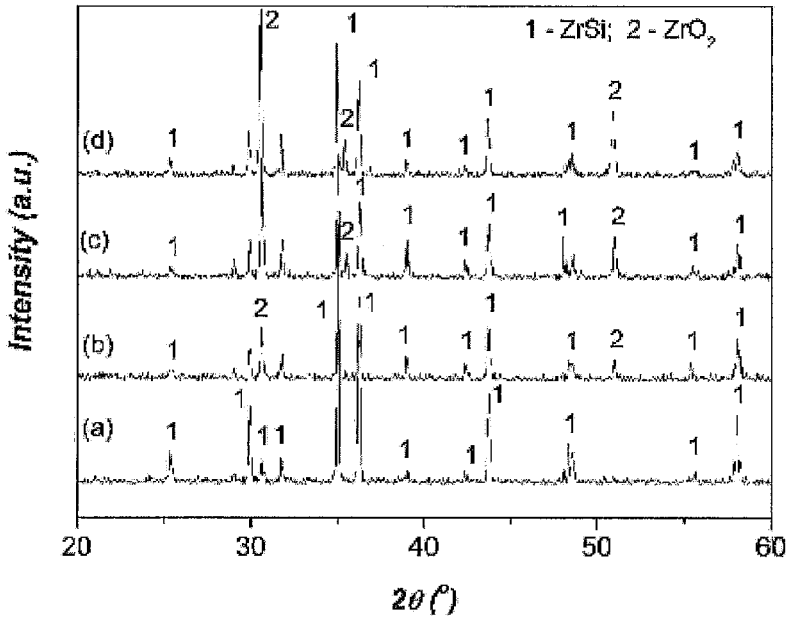
FIG. 4 is a graph showing results obtained by X-ray diffraction (XRD) analysis of a product according to the Mg mole ratio ($ZrSiO_4+\alpha Mg$, a) $\alpha$=4.0, b) $\alpha$=3.5, c) $\alpha$=3.0, d) $\alpha$=2.5) in the manufacturing method according to the present invention.

FIG. 4 is a graph showing results obtained by X-ray diffraction (XRD) analysis after leaching MgO contained in the synthesized product according to the Mg mole ratio. It may be appreciated that in the case in which the mole ratio of Mg was smaller than the stoichiometric ratio, ((b): 3.5 mol, (c): 3.0 mol, (d): 2.5 mol), $ZrO_2$ remains as un-reacted material, and in the case of 4 mol (a), single phase ZrSi in which un-reacted material was not present was obtained.

Figure 5:
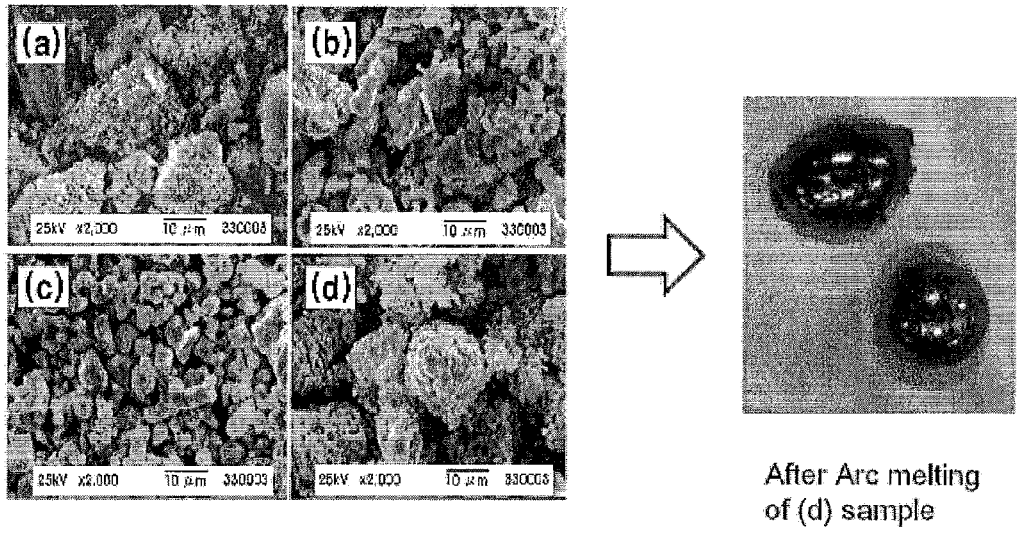
FIG. 5 shows scanning electron microscope (SEM) photographs of the product prepared by self-propagating high temperature synthesis (SHS) according to the mole ratio of Mg ($ZrSiO_4+\alpha Mg$, a) $\alpha$=2.5, b) $\alpha$=3.0, c) $\alpha$=3.5, d) $\alpha$=4.0) and a photograph of an ingot after Arc melting in the manufacturing method according to the present invention.

FIG. 5 is a SEM photograph showing shapes of the product according to the mole ratio of Mg. The higher the mole ratio of Mg, the higher the reaction temperature, such that coarse particles may be obtained. In addition, through a photograph after Arc melting of the single phase ZrSi, it was confirmed that ingot with metallic glittering was obtained.

EXAMPLE 2

Preparation ZrN by $ZrSiO_4$+Mg+N2 Reaction

Figure 6:
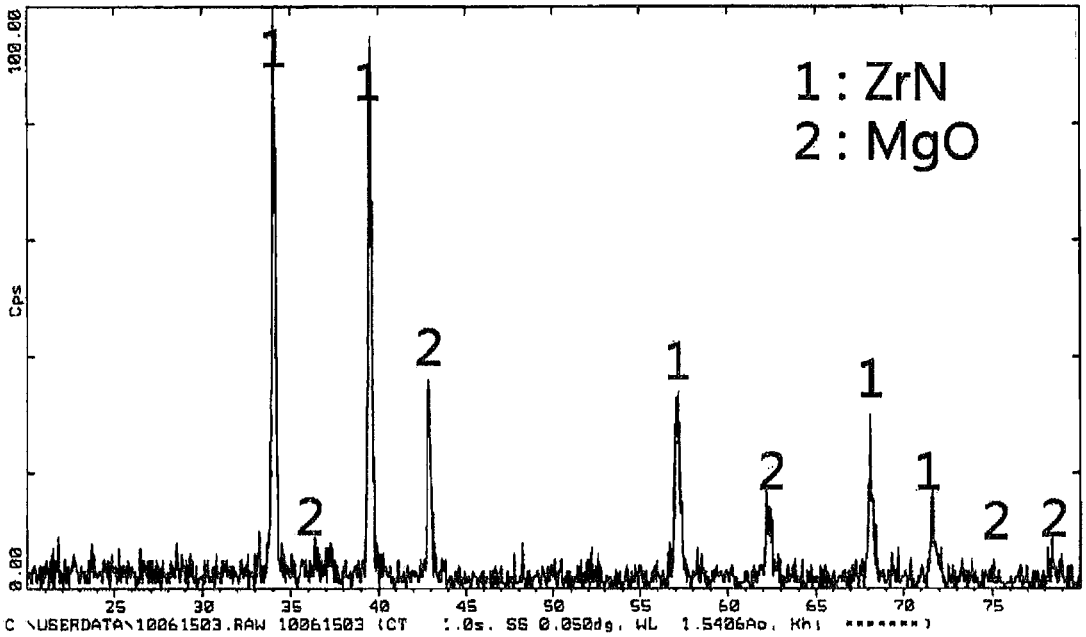
FIG. 6 is a graph showing results obtained by XRD analysis of ZrN prepared by introduction of N2 gas at the time of the SHS in the manufacturing method according to the present invention.
Figure 7:
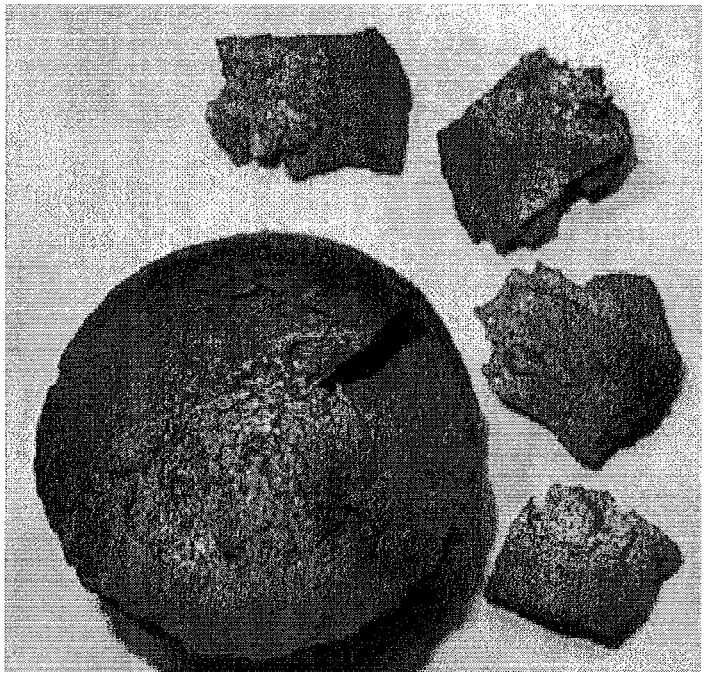
FIG. 7 is a photograph showing a shape of ZrN prepared by introduction of N2 gas at the time of the SHS in the manufacturing method according to the present invention.

In order to directly prepare ingot by increasing reaction temperature without an additional dissolution process, N2 gas (25 atm) was introduced in a $1ZrSiO_4$+1Mg system to induce a reaction. The reaction temperature was 2000° C. or more, and it was confirmed that ZrN was successfully prepared as the XRD analysis results of FIG. 6. Particularly, as shown in FIG. 7, it may be appreciated that the product was dissolved to thereby be obtained as a high density golden ingot, the product was appropriated for being used in the electrolytic refining process.

EXAMPLE 3

Recovery of Zr from ZrSi by Electrolytic Refining Process

Figure 8:
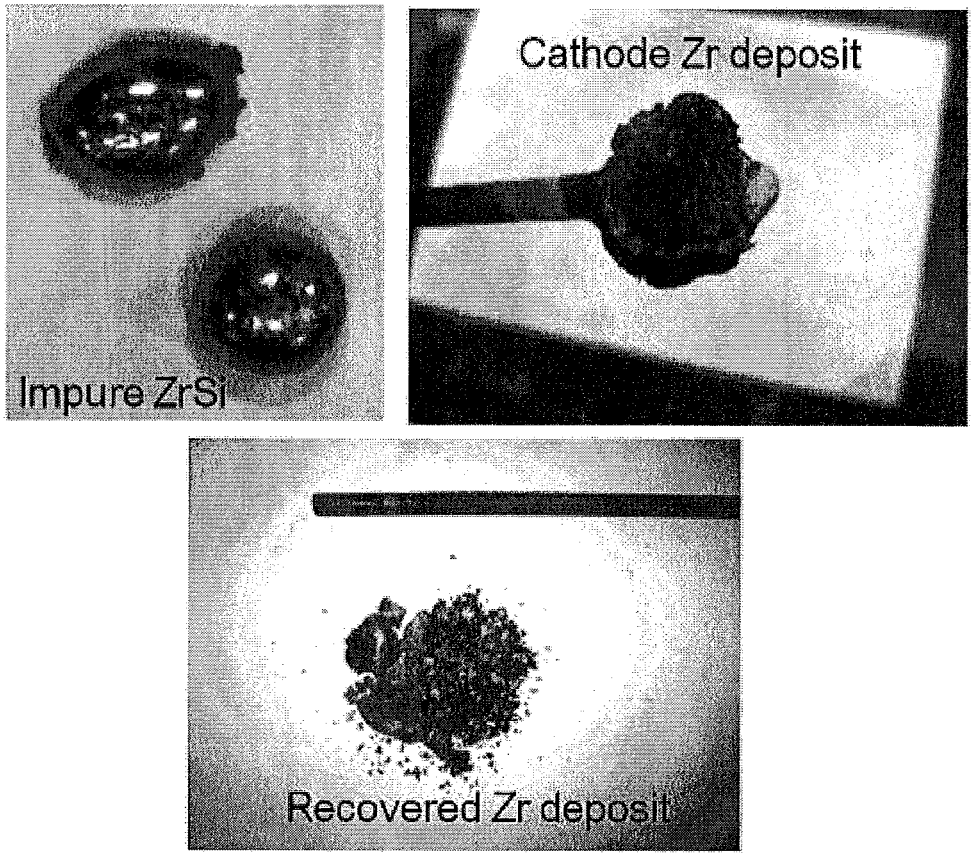
FIG. 8 is photographs of a shape of Zr deposit recovered by an electrolytic refining process according to the present invention.
Figure 9:
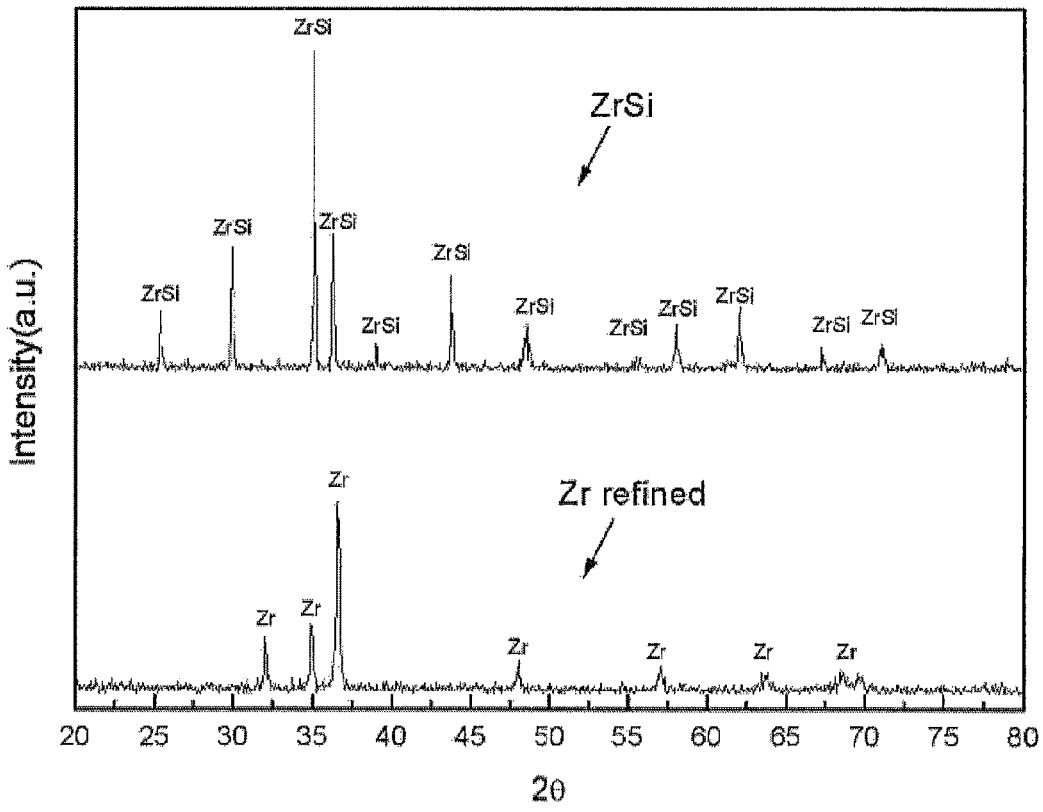
FIG. 9 is a graph showing results obtained by XRD analysis of the used ZrSi and recovered Zr deposit in the electrolytic refining process according to the present invention.

In order to recover reactor-grade Zr from ZrSi prepared in Example 1, the electrolytic refining process was performed using ZrSi ingot containing Hf shown in FIG. 8 as a raw material.

After 5 weight % of $ZrF_4$ (99.8%, Hf: 0.1 wt % or less, ALF product, 11542) was added to LiCl-KCl eutectic salt, the electrolytic refining was performed at 0.2 A for 5 hours while maintaining cell potential at 1.3V. At this time, the recovered zirconium deposit was electro-deposited on the stainless cathode as shown in FIG. 8, and it may be appreciated that pure Zr was recovered from an anode charging material that was ZrSi before the reaction. After removing a residual salt contained in the deposit recovered from the cathode, an amount of Hf was analyzed using inductively coupled plasma atomic emission spectroscopy (ICP).

As a result of analyzing Hf, the amount of Hf contained in initial ZrSi was 316.7 ppm, and the amount of Hf was lower than a detection limit of ICP not to be detected in the deposit after the electrolytic refining. Therefore, it may be appreciated that Hf was removed by electrolytic refining.

EXAMPLE 4

Recovery of Zr from ZrN by Electrolytic Refining Process

Figure 10:
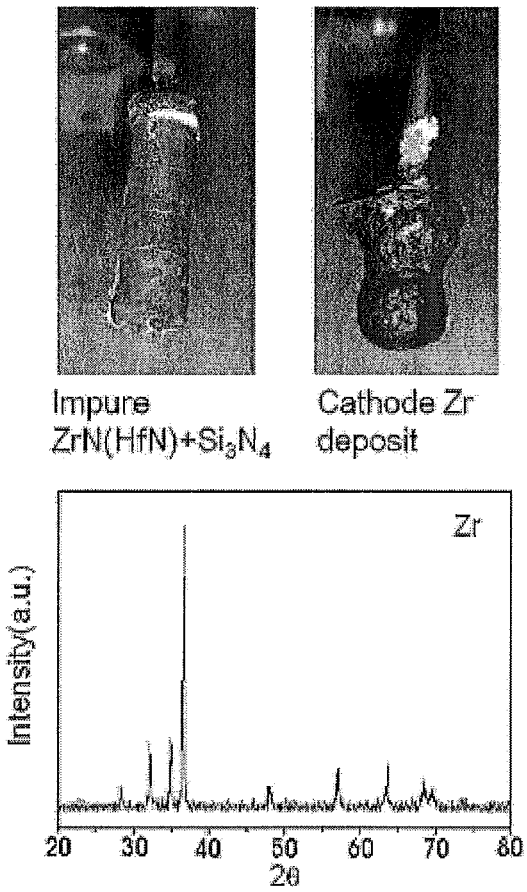
FIG. 10 is a photograph of shapes of the used ZrN and recovered Zr deposit in the electrolytic refining process according to the present invention and a graph showing results obtained by XRD analysis of the recovered Zr deposit.

In order to confirm electrolytic refining properties of the synthesized ZrN, ZrN was charged in an anode, and electrolytic refining was performed using the same electrolytic refining reaction apparatus as that in the case of ZrSi, as shown in FIG. 10. After 5 weight % of $ZrF_4$ (99.8%, Hf: 0.1 wt % or less, ALF product, 11542) was added to LiCl—KCl eutectic salt, electrolytic refining was performed at 1.5 A for 2 hours while maintaining cell potential at 1.5V. At this time, the recovered zirconium deposit was electro-deposited on a graphite cathode, pure Zr was recovered from an anode charging material that was ZrN before the reaction. After removing a residual salt contained in the deposit recovered from the cathode, an amount of Hf was analyzed using ICP, and as a result, it was analyzed that Hf of a detection limit or less was contained.

EXAMPLE 5

Zr Deposit Particle Size Coarsening

Figure 11:
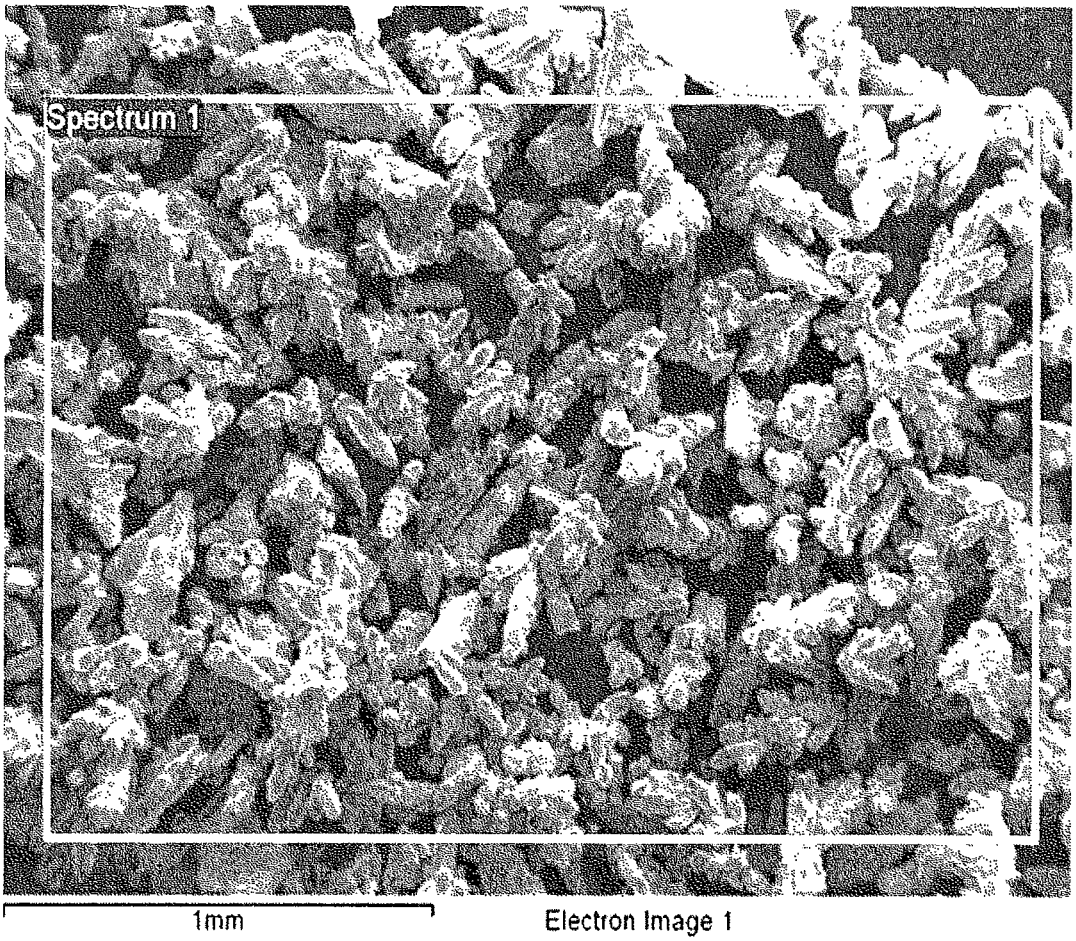
FIG. 11 is an SEM photograph of Zr deposit in the case of using LiF—KF—$ZrF_4$.
Figure 12:
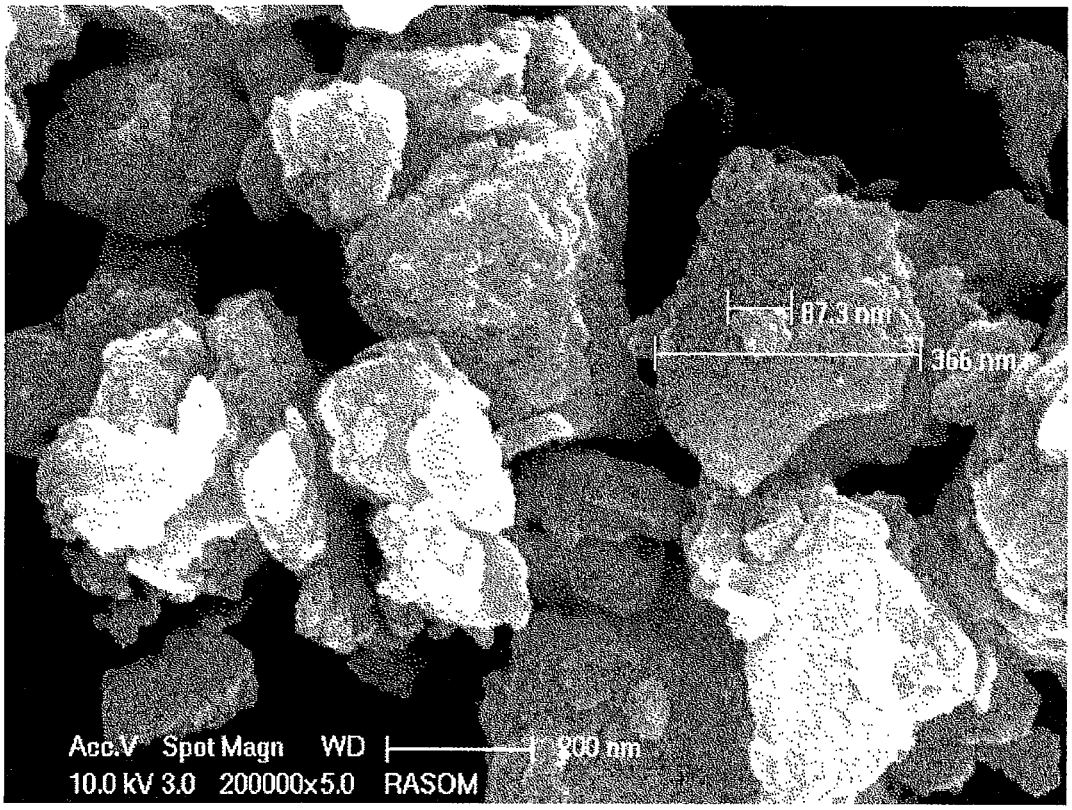
FIG. 12 is an SEM photograph of Zr deposit in the case of using LiCl—KCL-$ZrF_4$.

In order to coarsen a particle size of Zr deposit recovered by the electrolytic refining process, 3 weight % of $ZrF_4$ (99.8%, Hf: 0.1 wt % or less, ALF product, 11542) was added to LiF—KF eutectic salt, electrolytic refining was performed at 550° C. and 0.2 A for 5 hours while maintaining cell potential at 1.3V. a shape of Zr recovered in this case was shown in FIG. 11. The deposit recovered using LiCl—KCl eutectic salt had an average particle size of 1 μm or less as shown in FIG. 12. On the other hand, the deposit recovered using LiF—KF eutectic salt was a coarse resin phase having an average particle size of about 500 μm. Therefore, it was confirmed that the particle size may be controlled by controlling a composition of the eutectic salt.

Hereinabove, although the present invention is described by specific matters, exemplary embodiments, and drawings, they are provided only for assisting in the entire understanding of the present invention. Therefore, the present invention is not limited to the exemplary embodiments. Various modifications and changes may be made by those skilled in the art to which the present invention pertains from this description.

Therefore, the spirit of the present invention should not be limited to the above-described examples, and the following claims as well as all modified equally or equivalently to the claims are intended to fall within the scopes and spirits of the invention.

The invention claimed is:

1. A manufacturing method for high-purity Zirconium comprising self-propagating high temperature synthesis (SHS, self-sustained combustion synthesis) of a raw material having zirconium raw ore containing $ZrSiO_4$ and a reducing agent that is metal powder, to prepare $Zr_xSi_y$ (x is a real number of 1 to 5, and y is a real number of 1 to 4), followed by the recovery of high-purity Zr by electrolytic-refining $Zr_xSi_y$.

2. The manufacturing method for high-purity Zirconium of claim 1, wherein the raw material further contains zirconium oxide.

3. A manufacturing method for high-purity Zirconium comprising self-propagating high temperature synthesis (SHS, self-sustained combustion synthesis) of a material containing zirconium raw ore containing $ZrO_2$, $ZrSiO_4$, $KZr_2(PO_4)_3$, or a mixture thereof and a reducing agent that is metal powder, in the presence of nitrogen to prepare a mixture of HfN and ZrN, followed by the recovery of high-purity Zr by electrolytic-refining the mixture of HfN and ZrN.

4. The manufacturing method for high-purity Zirconium of claim 3, wherein at the time of the SHS, $Si_3N_4$ is volatilized and removed.

5. The manufacturing method for high-purity Zirconium of claim 1, wherein the reducing agent is Al, Mg, or a mixture thereof.

6. The manufacturing method for high-purity Zirconium of claim 1, wherein at the time of the SHS, pressure of atmospheric gas is 2 to 250 atm.

7. The manufacturing method for high-purity Zirconium of claim 1, wherein at the time of the SHS, a liquid phase is formed.

8. The manufacturing method for high-purity Zirconium of claim 1, after SHS, further comprising removing metal oxide produced by oxidation of the reducing agent using acid leaching.

9. The manufacturing method for high-purity Zirconium of claim 1, wherein the electrolytic refining is performed using molten salts in which 3 to 10 weight % of zirconium halide is added to LiCl—KCl, LiF—KF or LiF—KF—NaF eutectic salts.

10. The manufacturing method for high-purity Zirconium of claim 9, wherein at the time of the electrolytic refining, cell potential is 0.5 to 2V.

11. The manufacturing method for high-purity Zirconium of claim 9, wherein at the time of the electrolytic refining, a mole ratio of hafnium ions to zirconium ions ($Hf^{4+}/Zr^{4+}$or $Hf^{3+}/Zr^{3+}$) in the eutectic salt is 0.5 or less.

12. The manufacturing method for high-purity Zirconium of claim 1, wherein high-purity Zirconium recovered by electrolytic refining contains Hf at a concentration of 100 weight ppm or less.

13. The manufacturing method for high-purity Zirconium of claim 9, wherein the molten salt is purified by a Czochralski method to sequentially and directionally solidify the molten salt using the fact that a content of thermally stable impurities is changed according to the temperature in a two phase region in which a solid phase and a liquid phase co-exist in a phase diagram of substances configuring molten salts and reused.

* * * * *